United States Patent [19]

Price

[11] 4,289,458

[45] Sep. 15, 1981

[54] FOOT PUMPS

[75] Inventor: Ernest J. Price, Solihull, England

[73] Assignee: E. J. Price (Developments) Limited, Birmingham, England

[21] Appl. No.: 905,560

[22] Filed: May 12, 1978

[30] Foreign Application Priority Data

May 13, 1977 [GB] United Kingdom ..... 20095/77

[51] Int. Cl.[3] ..... F04B 19/02; F04B 29/00

[52] U.S. Cl. ..... 417/464; 417/903

[58] Field of Search ..... 417/464, 903

[56] References Cited

U.S. PATENT DOCUMENTS

| | | | |
|---|---|---|---|
| 148,809 | 3/1874 | Coffin | 417/903 |
| 996,882 | 4/1911 | Reddy | 417/903 |
| 2,609,000 | 9/1952 | Mowbray | 417/903 |
| 2,978,727 | 4/1961 | Forster | 417/903 |
| 3,385,530 | 5/1968 | Irwin | 16/172 |
| 3,698,260 | 10/1972 | Shellhause | 16/172 |
| 3,979,148 | 9/1976 | Martin | 16/172 |
| 4,084,214 | 4/1978 | Eppich | 16/172 |

FOREIGN PATENT DOCUMENTS

| | | | |
|---|---|---|---|
| 267031 | 8/1946 | Switzerland | 417/464 |
| 191322 | 1/1923 | United Kingdom | 417/464 |
| 865105 | 4/1961 | United Kingdom | 417/464 |
| 1471884 | 5/1977 | United Kingdom | 417/903 |

*Primary Examiner*—William L. Freeh

*Attorney, Agent, or Firm*—Scrivener, Clarke, Scrivener and Johnson

[57] ABSTRACT

A foot pump comprises a base member and an operating member pivotally connected to the base member. A piston-and-cylinder assembly is connected between the members. In use the user depresses the operating member with his or her foot, thereby causing air to be compressed in and expelled from said assembly. A return spring returns the operating member to its raised position. The base and operating members have complementary pivot pin and hook means which are hooked together to form the pivotal connection between the members. The members are preferably made as unitary plastics mouldings, the pivot pin and hook means being resiliently clipped together.

12 Claims, 9 Drawing Figures

FOOT PUMPS

Figure 1:
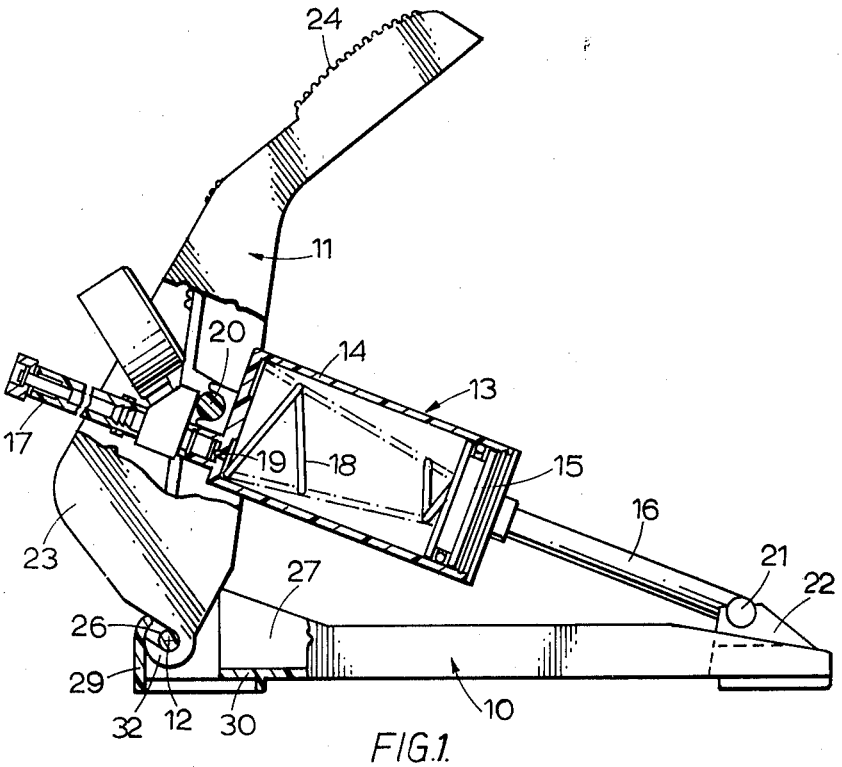

This invention relates to foot pumps, and in particular to foot pumps of the kind (hereinafter referred to as the kind specified) comprising a base member, an operating member pivotally connected to the base member and which in use can be depressed by the user's foot from a raised position, a piston-and-cylinder assembly connected between the operating member and the base member and operative to compress or expel air when the operating member is depressed from its raised position, and return spring means operative in use to urge the operating member towards its raised position. Such foot pumps are in general used for the inflation of the tyres of motor vehicles, though they may be used for other purposes, such as the inflation of air-beds, toy balls and other articles.

Hitherto it has been the usual practice to provide aligned holes in the operating and base members, to insert a pivot pin through those holes and to secure this pivot pin in position with a nut or other fastening. The aim of the present invention is to provide a construction which is simpler than that and can be assembled more simply, thereby making it possible to reduce the cost of manufacturing and assembling the foot pump.

From one aspect the present invention consists in a foot pump of the kind specified characterised in that said members have complementary pivot pin means and hook means, which means are hooked together to form the pivotal connection between the members.

From another aspect the present invention consists in the components of a foot pump of the kind specified, as outlined in the last preceding paragraph, and including a base member and an operating member, which members have complementary pivot pin means and hook means, which means can be hooked together to form said pivotal connection between the members.

One of said members, with the pivot pin means, is preferably formed as a unitary moulding of a plastics material, said pivot pin means comprising at least one pivot pin. If there is more than one pivot pin, the pivot pins are mutually aligned. Preferably the pivot pin or each pivot pin is supported at both ends.

Likewise, one of said members, with the hook means, is preferably formed as a unitary moulding of a plastics material, said hook means comprising at least one hook. If there is more than one hook, the hooks are mutually aligned.

The hook means may be retained in pivotal engagement with the pivot pin means in any of a number of different ways. For example a locking component may be mounted so as to close at least partially the hook means so as to prevent disengagement of the hook means and the pivot pin means. Preferably, however, the hook means is resiliently clipped onto the pivot pin means during assembly; and in a preferred construction the hook means is so shaped as to define a groove, the inner part of which receives the pivot pin means and the outer parts of which are narrower than the inner part, whereby during assembly the pivot pin means can be introduced into the inner part of the groove by being pushed through the outer parts of the groove, these outer parts opening sufficiently to permit the passage of the pivot pin means and subsequently returning to their original width due to the resilience of the material from which the hook means is formed.

When the hook means is so shaped as to define a groove which receives the pivot pin means, the groove preferably opens in a direction such that when the pump is in use the force exerted to depress the operating member and the force exerted by the spring means tend to retain the pivot pin means in the groove rather than to urge it out of the groove.

Preferably said members have complementary concave and convex bearing surfaces spaced outwardly from the pivotal connection and operative in use to transmit reaction forces front one member to the other. This arrangement reduces the load on the pivot pin means in use.

The base and operating members are preferably formed with complementary abutment surfaces adjacent to the hook means and pivot pin means and such that during assembly the hook means can be placed adjacent to the pivot pin means and on relative movement of the members the abutment surfaces can engage each other and cause said means to become hooked together. The arrangement is preferably such that during assembly the members become hooked together by relative movement of the members from a raised position to a fully depressed position. In this way the members can be assembled simply and quickly; as the abutment surfaces are adjacent to the pivotal connection between the members it is normally possible for the user to obtain a mechanical advantage in that the user can manipulate those end parts of the members remote from the pivotal connection and from the abutment surfaces. Even if considerable force is required to insert the pivot pin means into the hook means this may be generated by the application of a much smaller force to the members by the person assembling the members. The arrangement is preferably such that the members can be assembled manually, without the need for ancillary apparatus.

In a preferred construction the base member has the pivot pin means and the operative member has the hook means. It must be understood however that this arrangement may be reversed if desired, the operative member having the pivot pin means and the base member having the complementary hook means.

Figure 2:
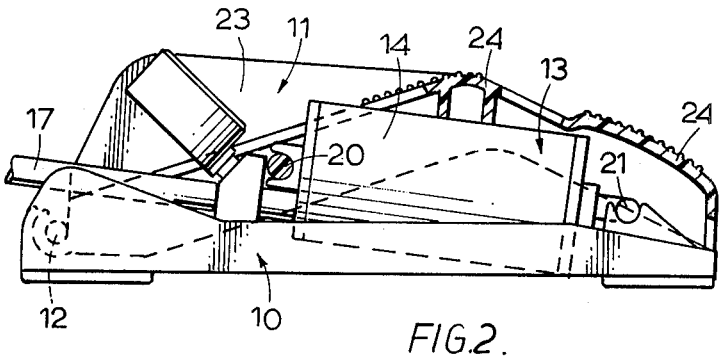
Figure 3:
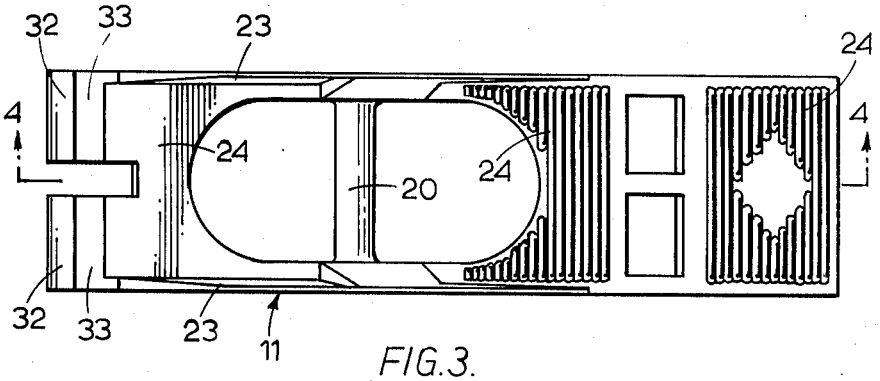
Figure 4:
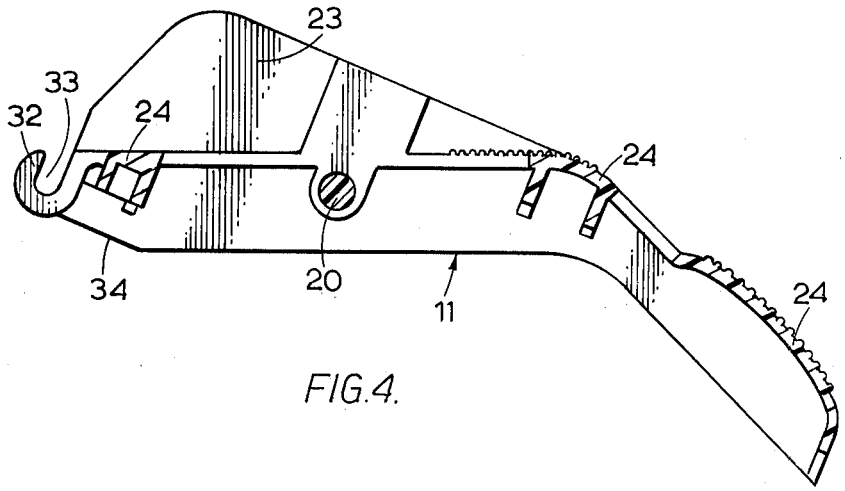
Figure 5:
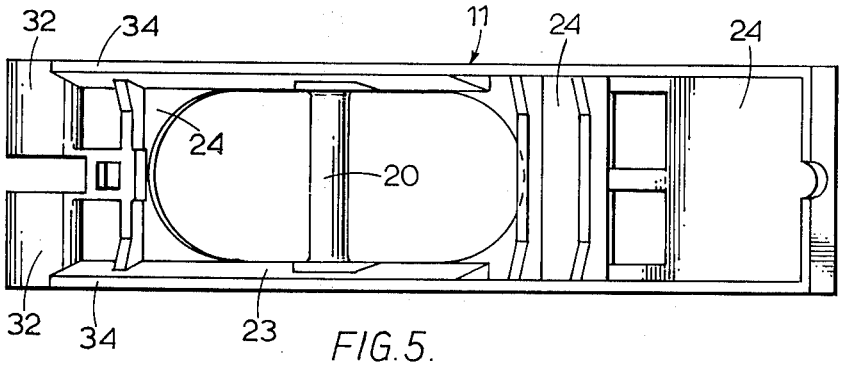
Figure 6:
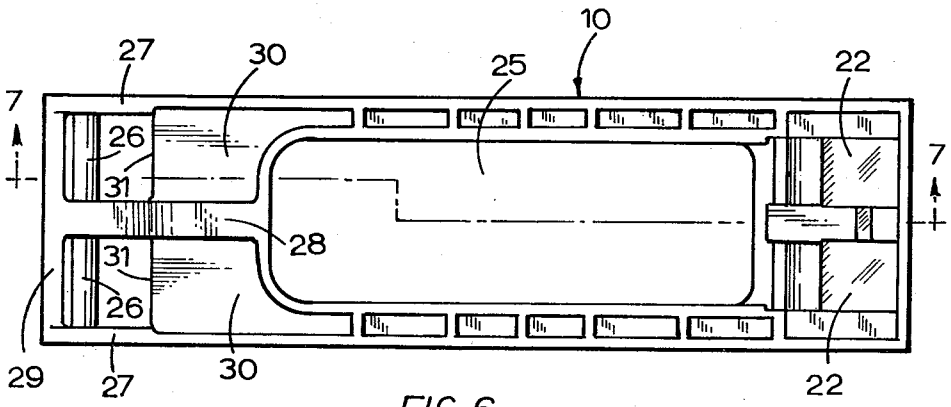
Figure 7:
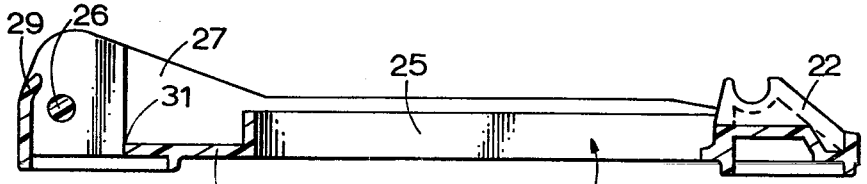
Figure 8:
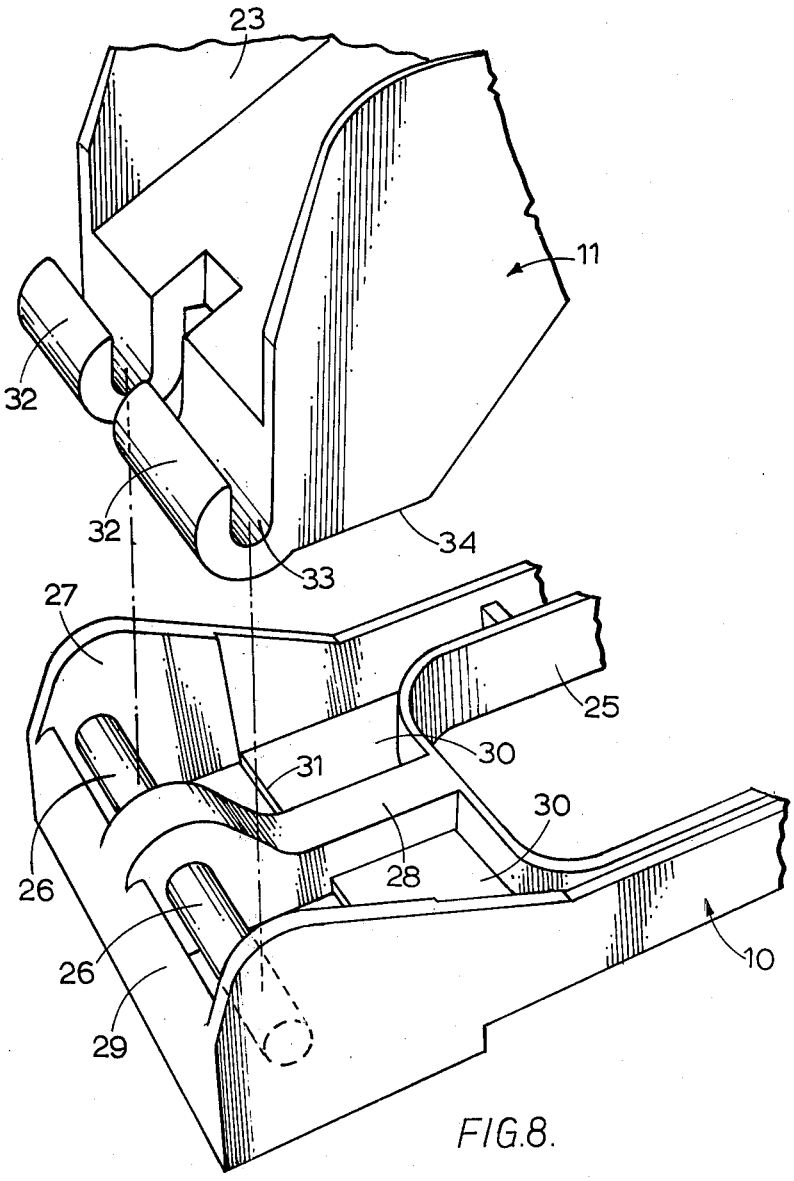
Figure 9:
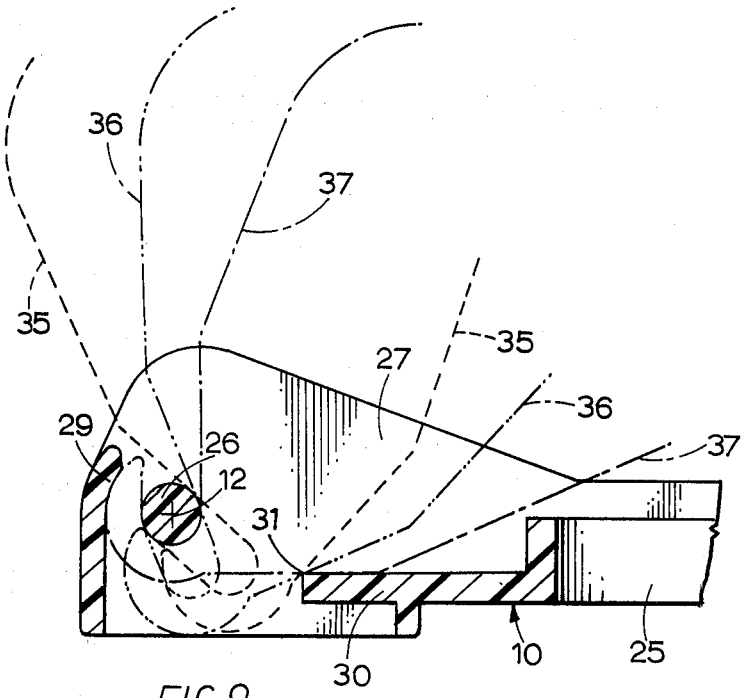

A foot pump embodying the present invention will now be described in more detail, by way of example, with reference to the accompanying drawings, in which:

FIG. 1 is a side view of a foot pump embodying the present invention, the operating member being in its raised position, and some parts being shown in section for clarity of illustration, FIG. 2 is a side view of the foot pump with the operating member in its fully depressed position, some parts again being shown in section for clarity, FIG. 3 is a plan view of the operating member of the foot pump, FIG. 4 is a section through the operating member, along the line 4—4 of FIG. 3, FIG. 5 is a view of the operating member from beneath, FIG. 6 is a plan view of the base member of the foot pump, FIG. 7 is a section through the base member, along the line 7—7 of FIG. 6, FIG. 8 is a perspective view to a larger scale of parts of the operating member and base before they are assembled, and FIG. 9 is a section through part of the base member, along the line 7—7 of FIG. 6 but to a larger scale, and includes the outline of the operating member in each of three successive positions it assumes during assembly.

As shown in FIGS. 1 and 2 the foot pump comprises a base member 10 which in use rests on the ground and extends generally horizontally, and an operating member 11 which is connected to it so as to be pivotally movable about an axis 12. A piston-and-cylinder assembly 13 is connected between the base and operating members and comprises a cylinder 14 containing a piston 15 attached to a piston rod 16. The assembly 13 is of the usual kind such that during its operative stroke when the piston rod 16 is pushed into the cylinder, causing the piston to travel along the interior of the cylinder, air is compressed or is expelled through a flexible outlet tube 17. The return stroke is effected by a compression spring 18 disposed inside the cylinder and acting on the piston. During the return stroke a non-return valve 19 prevents air from entering the cylinder through the tube 17, while air is enabled to pass from one side of the piston to the other. The details of the assembly 13 form no part of the present invention and are of a generally conventional nature. They will therefore not be described in any more detail. The cylinder 14 is pivotally connected to a pivot rod 20 on the operating member 11, while the end of the piston rod 16 further from the piston has trunnions 21 which pivotally engage bearings 22 in the base member 10. In use the user depresses the operating member 11, with his or her foot, from the raised position shown in FIG. 1 to the depressed position shown in FIG. 2, thereby causing an operative stroke of the piston-and-cylinder assembly. In so doing the user overcomes the force exerted by the spring 18, causing the spring to be compressed or loaded. The user then releases the operating member 11 which returns to the raised position under the influence of the spring 18, this bringing about the return stroke of the assembly.

All that has been described above is of a generally conventional nature. In the embodiment illustrated, however, the base member 10 and the operating member 11 are each made as a unitary moulding of a plastics material such as a talc-filled polypropylene. The operating member 11 has relatively extensive side flanges 23, for strength, and transverse portions 24, which are ribbed on the upper surface to reduce the likelihood of the sole of the user's shoe slipping on them in use. The pivot rod 20 is also integrally formed with the operating member. The base member 10 is mainly shaped as a rectangular frame having a central opening 25 which is partially entered by the cylinder 14 when the operating member is in its depressed position (FIG. 2).

The members 10 and 11 are pivotally connected by means of formations formed as integral parts of those members. The base member 10 is formed with coaxial pivot pins 26 each of which is supported at each end and extends between an adjacent side wall 27 of the member and a central support 28. The adjacent end wall 29 of the base member has an upper part presenting a concave bearing surface co-axial with the pivot pins 26. The central part of that end wall 29 is also strengthened by being integrally joined to the central support 28. Between the support 28 and the side walls 27 there are integrally formed abutment plates 30 that extend towards the pivot pins 26 and end wall 29 but terminate somewhat short of them at a horizontal, transverse abutment edge 31, so that the base member is open immediately beneath the pivot pins 26.

The operating member 11 is formed with integral hook means in the form of a pair of hooks 32 having a common groove 33. The inner part of the groove is shaped to receive the pivot pins 26, while the outer parts of the groove are somewhat narrower. The hooks 32 are spaced apart by a distance slightly greater than the width of the central support 28, while the width of each hook is slightly less than the length of each of the pivot pins 26. Adjacent to the hooks 32 the side flanges 23 are formed with abutment formations 34.

During assembly of the pump the operating member 11 is manipulated to the position shown in the broken lines 35 in FIG. 9, the member being near its raised position, and the mouth of the groove 33 being just beneath the pivot pins 26. The operating member 10 is then moved to its depressed position. As that movement occurs the abutment formations 34 engage the abutment edge 31, and the two members 10 and 11 rock about an axis through that edge. The hooks 32 are forced upwards so as to receive the pivot pins 26. As the pivot pins pass through the outer part of the groove 33 the hooks open resiliently to allow the pins to pass. An intermediate position is shown in the chain-dotted lines 36. Finally, when the operating member 11 has been lowered to its fully depressed position, as shown in the chain-dotted lines 37, the pins are fully received in the inner part of the groove 33, and the hooks return resiliently to their initial shapes. Thereafter, in normal use, the pivot pins will remain fully engaged in the groove. The resistance afforded by the hooks to the insertion of the pivot pins is such that with the mechanical advantage obtained the assembly can readily be effected manually.

In a modified construction the groove in the hooks is of uniform width so that the hooks do not clip onto the pivot pins but are retained in engagement with the pivot pins by friction and by the forces acting on the members in use.

It will be appreciated that the forces exerted on the members 10 and 11 by the spring 18 and by the user's foot tend to urge the hooks 32 in directions such that the pins 26 are urged into the groove 33 rather than out of it. In this way there is no tendency for the members to become disconnected from each other in use.

When the operating member is in its raised position, as shown in FIG. 1, the side flanges 23 abut the inturned top of the end wall 29. If, in use, forces are inadvertently applied to the members 10 and 11 such as to urge the operating member higher than its raised position, those forces are resisted by that engagement, and there is thus no tendency for the hooks 32 to be disengaged from the pivot pins 26.

The outer surfaces of the hooks 32 are of part-cylindrical, convex shape and in use slide against the concave face of the upper part of the end wall 29. Thus, in use, some of the reaction forces are transmitted from one member to the other through those surfaces rather than through the pivot pins 26.

In a modified construction, which is not illustrated, the pivot pins form part of the operating member while the hooks form part of the base member. The relative disposition of the pins and hooks in such a construction can readily be appreciated by taking the pump illustrated in the accompanying drawings and turning it so that the pump rests on the operating member, while the base member is in a raised position.

I claim:

1. A foot pump of the kind comprising a base member, an operating member, and a pivotal connection between said members, said operating member in use being depressed by the user's foot from a raised position, a piston-and-cylinder assembly connected between the operating member and the base member and operative to compress or expel air when the operating member is depressed from its raised position, and return spring means operative to urge the operating member towards its raised position, the invention wherein said pivotal connection comprises pivot pin means carried by one of said members and hook means carried by the other thereof; said pivot pin means and said hook means being constructed and arranged to be hooked together to form the pivotal connection between the members, said hook means being resiliently clipped onto the pivot pin means during assembly and opening in a direction that when the pump is in use the force exerted to depress the operating member and the force exerted by the spring means tends to retain the pivot pin means in the hook means rather than to urge the pivot pin means out of the hook means.

2. A foot pump according to claim 1 in which the hook means is so shaped as to define a groove, the inner part of which receives the pivot pin means and the outer parts of which are narrower than the inner part, whereby during assembly the pivot pin means can be introduced into the inner part of the groove by being pushed through the outer parts of the groove, those outer parts opening sufficient to permit the passage of the pivot pin means and subsequently returning to their original width due to the resilience of the material from which the hook means is formed.

3. A foot pump of the kind set forth comprising a base member, an operating member, and a pivotal connection between said members, said operating member in use being depressed by the user's foot from a raised position, a piston-and-cylinder assembly connected between the operating member and the base member and operative to compress or expel air when the operating member is depressed from its raised position, and return spring means operative to urge the operating member towards its raised position, the invention wherein said pivotal connection comprises pivot means carried by one of said members and hook means carried by the other thereof; said pivot pin means and said hook means being constructed and arranged to be hooked together to form the pivotal connection between the members, said hook means being so shaped as to define a groove which receives the pivot pin means, and said groove opening in a direction that when the pump is in use the force exerted to depress the operating member and the force exerted by the spring means tends to retain the pivot pin means in the hook means rather than to urge the pivot pin means out of the hook means.

4. A foot pump according to claim 3 in which one of said members, with the pivot pin means, is formed as a unitary moulding of a plastics material, said pivot pin means comprising at least one pivot pin.

5. A foot pump according to claim 3 in which the pivot pin means comprises at least one pivot pin supported at both ends.

6. A foot pump according to claim 3 in which one of said members, with the hook means, is formed as a unitary moulding of a plastics material, said hook means comprising at least one hook.

7. A foot pump according to claim 3 in which the base member has the pivot pin means and the operating member has the hook means.

8. A foot pump according to claim 3 wherein said pivot pin means and said hook means are integral with the respective members.

9. A foot pump of the kind comprising a base member, an operating member, and a pivotal connection between said members, said operating member in use being depressed by the user's foot from a raised position, a piston-and-cylinder assembly connected between the operating member and the base member and operative to compress or expel air when the operating member is depressed from its raised position, and return spring means operative to urge the operating member towards its raised position, the invention wherein said pivotal connection comprises pivot pin means carried by one of said members and hook means carried by the other thereof; said pivot pin means and said hook means being constructed and arranged to be hooked together to form the pivotal connection between the members, said hook means opening in a direction that when the pump is in use the force exerted to depress the operating member and the force exerted by the spring means tends to retain the pivot pin means in the hook means rather than to urge the pivot pin means out of the hook means, said members having complementary concave and convex bearing surfaces spaced outwardly from the pivotal connection and operative in use to transmit reaction forces from one member to the other.

10. A foot pump according to claim 9 wherein the concave bearing surface is defined by an upstanding end wall on the base member and the cooperating convex bearing surface is on the operating member, said end wall having an upper edge part which is engaged by said operating member when in its raised position to resist any force tending to urge said operating member higher then its raised position and any tendency for the hook means to be thereby disengaged from said pivot pin means.

11. A foot pump of the kind comprising a base member, an operating member, and a pivotal connection between said members, said operating member in use being depressed by the user's foot from a raised position, a piston-and-cylinder assembly connected between the operating member and the base member and operative to compress or expel air when the operating member is depressed from its raised position, and return spring means operative to urge the operating member towards its raised position, the invention wherein said pivotal connection comprises pivot pin means carried by one of said members and hook means carried by the other thereof; said pivot pin means and said hook means being constructed and arranged to be hooked together to form the pivotal connection between the members, said hook means opening in a direction that when the pump is in use the force exerted to depress the operating member and the force exerted by the spring means tends to retain the pivot pin means in the hook means rather than to urge the pivot pin means out of the hook means, said members being formed with complementary abutment surfaces adjacent to the hook means and pivot pin means such that during assembly the hook means can be placed adjacent to the pivot pin means and on relative movement of the members the abutment surfaces engage each other and cause said means to become hooked together.

12. A foot pump according to claim 11 in which during assembly members become hooked together by relative movement of the members from a raised position to a fully depressed position.

* * * * *